US007963398B2

(12) United States Patent
Robl et al.

(10) Patent No.: US 7,963,398 B2
(45) Date of Patent: Jun. 21, 2011

(54) METHOD FOR HYDRAULICALLY SEPARATING CARBON AND CLASSIFYING COAL COMBUSTION ASH

(75) Inventors: Thomas L. Robl, Sadieville, KY (US); John Groppo, Wilmore, KY (US)

(73) Assignee: University of Kentucky Research Foundation, Lexington, KY (US)

( * ) Notice: Subject to any disclaimer, the term of this patent is extended or adjusted under 35 U.S.C. 154(b) by 1122 days.

(21) Appl. No.: 11/451,672

(22) Filed: Jun. 13, 2006

(65) Prior Publication Data

US 2007/0284291 A1 Dec. 13, 2007

(51) Int. Cl.
*B03B 5/62* (2006.01)

(52) U.S. Cl. ..... 209/157

(58) Field of Classification Search ..... 209/132, 209/155, 208, 210, 156, 172–206, 157–161
See application file for complete search history.

(56) References Cited

U.S. PATENT DOCUMENTS

| | | | | |
|---|---|---|---|---|
| 1,109,529 | A * | 9/1914 | Jaffe | 209/156 |
| 1,198,404 | A * | 9/1916 | Ballantine | 241/79.1 |
| 1,746,156 | A | 2/1930 | Jahn | |
| 2,868,384 | A | 1/1959 | Puddington | |
| 3,262,560 | A * | 7/1966 | Dergo et al. | 209/17 |
| 3,903,000 | A * | 9/1975 | Miura et al. | 210/251 |
| 4,033,863 | A | 7/1977 | Stone | |
| 4,346,005 | A * | 8/1982 | Zimmerman | 210/232 |
| 4,363,730 | A | 12/1982 | Gustafsson | |
| 4,595,504 | A | 6/1986 | Hellman et al. | |
| 4,681,683 | A | 7/1987 | Lindstol | |
| 4,701,260 | A | 10/1987 | Lee | |
| 4,747,948 | A | 5/1988 | North | |
| 4,810,370 | A | 3/1989 | Taskinen | |
| 4,889,624 | A | 12/1989 | Soriente et al. | |
| 4,961,843 | A | 10/1990 | Lewis | |
| 5,340,470 | A | 8/1994 | Hedrick et al. | |
| 5,452,805 | A | 9/1995 | Robertson et al. | |
| 5,474,688 | A | 12/1995 | Hedrick et al. | |
| 5,536,409 | A * | 7/1996 | Dunkers | 210/519 |
| 5,698,102 | A | 12/1997 | Khudenko | |
| 5,700,378 | A | 12/1997 | Lee et al. | |
| 5,817,230 | A * | 10/1998 | Groppo et al. | 209/166 |
| 6,139,960 | A * | 10/2000 | Styron et al. | 428/402 |
| 6,533,848 | B1 * | 3/2003 | Robl et al. | 209/166 |
| 6,797,908 | B2 * | 9/2004 | Yan et al. | 209/131 |

FOREIGN PATENT DOCUMENTS

| | | | |
|---|---|---|---|
| DE | 70897 | | 9/1893 |
| GB | 2150039 | | 6/1985 |
| GB | 2150039 A | * | 6/1985 |
| WO | WO 86/05412 | | 9/1986 |

* cited by examiner

*Primary Examiner* — Joseph C Rodriguez
*Assistant Examiner* — Kalyanavenkateshware Kumar
(74) *Attorney, Agent, or Firm* — King & Schickli, PLLC

(57) ABSTRACT

A method for selective separation of particles from a particle-containing material includes preparing a slurry of the particle-containing material and a dispersant, passing the slurry through a hydraulic classifier in a first direction, establishing a particle flow in a direction that is different from the first direction, and recovering particles having a mean particle size of about 2-7 μm. The flow of particles defines a cross-current flow relative to the slurry feed direction. The method further includes providing the classifier with an interior divider assembly defining at least one inclined channel. The divider assembly typically includes a plurality of substantially parallel dividers separating the classifier into multiple channels having a substantially equal internal volume. A hydraulic classifier for separating particles having a mean particle size of from about 2-7 μm in accordance with the present method is provided also.

21 Claims, 9 Drawing Sheets

METHOD FOR HYDRAULICALLY SEPARATING CARBON AND CLASSIFYING COAL COMBUSTION ASH

This invention was made with partial Government support under DOE Contract No. DE-FC26-03NT41726. The Government may have certain rights in this invention.

TECHNICAL FIELD

The present invention relates generally to hydraulic size classification of particles contained in a slurry. More specifically, the invention relates to a method for cross-flow hydraulic classification of particles in a slurry for recovery of, in particular, particles having a mean particle size of from about 2-7 μm, and to a hydraulic classifier for accomplishing the method. The method and device find a variety of uses, including separation of carbonaceous particles from coal combustion (fly) ash, and classification of such fly ash.

BACKGROUND OF THE INVENTION

The United States is the largest mining country in the world. In 2001, the mining industry produced $57.3 billion in raw materials, of which $19.0 billion was derived from coal. The mineral processing industries increased the value of the minerals to $374 billion, while coal and uranium were used to produce $147 billion of electricity. Thus, the minerals and coal industries combined to contribute $521 billion to the nation's wealth (approximately 5.2% of the Gross National Product).

A major problem faced by the coal industry is environmental concerns created during coal production. According to a National Research Council report, the U.S. coal industry discards 70-90 million tons of fine coal annually to approximately 713 active impoundments. There is accordingly a need in the art for improved processes for processing fine coal to improve recovery of potentially useful products from such waste materials and reduce the need for discarding into waste piles and fine coal impoundments.

The industry has placed emphasis on improvements in physical separations of valuable substances from undesired substances. As a general rule, separation efficiencies decrease as the size of the particle being separated decreases. Methods evaluated to date may be considered to fall into three categories: (1) size-size separations (screening, classification); (2) solid-solid separations (flotation, selective flocculation, magnetic/electrostatic separation, gravity separation); and (3) solid-liquid separations (thickening, centrifugation, filtration, drying).

The most common classifier used for fine particle classification in mineral processing applications is the hydrocyclone, which is commonly used to separate particles as fine as 75 μm. Although separations as fine as 45 μm can be achieved, to do so the geometry of the hydrocyclone becomes much smaller and the capacity is reduced. Capacity limitations can be remedied by increasing the number of cyclones used, but the small apertures necessary are prone to plugging. As such, hydrocyclones are not suitable for efficient classification of ultrafine particles.

It is known to use hydraulic classifiers to separate particulates from a slurry by gravity sedimentation. Such hydraulic classifiers are designed primarily to de-slime materials, and place an emphasis on achieving clean coarse fractions. In general, conventional hydraulic classification is considered to be relatively ineffective on particles having a size <35 μm. Therefore, use of hydraulic classifiers in, for example, removal of carbon from fly ash being separated (beneficiated) for use in, e.g., cement or concrete as a mineral admixture has received limited attention.

Conventionally designed hydraulic classifiers provide a trough-shaped body defining one or more cells, and may optionally include substantially upright dividers of varying heights separating each cell. Each cell includes an outlet or underflow near the bottom thereof for removing particles as settling occurs. In use, a feed flow is established across the classifier. The largest particles will separate and can be removed from the first underflow, and so on. The finest particles will pass through the system, and may be discarded or collected, such as in a launder placed at an end of the classifier.

Such conventional hydraulic classifiers suffer from the disadvantage of inability to efficiently sort particle sizes of <7 μm. Further, blanket settling, a phenomenon wherein in a mix with differing particle sizes all of the particles settle concomitantly due to larger particles entraining smaller particles and hindering their movement, is a known disadvantage of such classifiers. Still further, most ores or other materials subject to hydraulic classification do not operate in the <10 μm range. Most ores are "deslimed" at anywhere from 200 to 325 mesh (74-45 μm). Coal fines, for example, are typically in the 100-200 mesh (150-74 μm) size range. The slimes, which may include potentially valuable fine particles, are considered a waste product in most mineral processing circuits.

As noted above, hydraulic classifiers having substantially vertical dividers (weirs) of differing heights are known also, and have been evaluated to attempt to improve selectivity for finer particles. However, such classifiers disadvantageously create thick sediment compression zones at or near the dividers, which hinders particle movement and size sorting and therefore efficiency, and results in relatively low throughput. Discharging settled solids from a single withdrawal point results in a high proportion of water also being withdrawn, thus creating disturbances in the bed of settled solids and short-circuiting of fine particles in the feed into the underflow. This limitation has been addressed by some design improvements that incorporate an elongated cone-shaped bed of settled solids that tapers to a discharge point at sufficient depth from the settling zone such that withdrawal of settled solids does not disturb particle sorting in the settling zone. However, with such a withdrawal geometry, fine particles entrained in the settled solids will be withdrawn with the coarse settled solids. Accordingly, conventional hydraulic classifiers are simply unsuited for sorting particle sizes of <7 μm.

SUMMARY OF THE INVENTION

To overcome the disadvantages of conventional hydraulic classifiers as discussed above, in one aspect the present invention provides a method for selective separation of particles from a particle-containing material, comprising preparing a slurry comprising the particle-containing material, a slurrying liquid, and a dispersant, passing the slurry through a hydraulic classifier in a first direction, establishing a flow of particles in a second direction that is different from the first direction, and recovering particles having a mean particle size of about 2-7 μm. The method is suitable for separation/beneficiation of particle-containing materials such as fly ash, but is not limited thereto. It will be appreciated that in the method of this invention, the flow of particles defines a cross-current flow relative to the first direction. This contrasts with known separation methods for particle-containing materials and/or waste removal methods from, for example sewage, which rely on co-current or countercurrent separations.

The method of this invention further includes the step of providing the hydraulic classifier with an interior divider assembly defining at least one inclined channel. Typically, the divider assembly comprises at least one divider disposed at a pitch that is greater than an angle of repose of the particle-containing material particles. In other words, the at least one divider is disposed at a pitch greater than that at which particles in the particle-containing material will tend to rest on the divider and form a sediment. It will be appreciated that the flow of particles described above is established by orienting the divider in the classifier whereby the divider surface on which the particles settle is substantially transverse to the direction of slurry flow through the classifier. In one embodiment, the at least one divider may be disposed at an included angle of about 45° relative to a plane defined by a longitudinal axis of the classifier. In another embodiment, the method includes the step of providing a divider assembly comprising a plurality of substantially parallel dividers which separate the classifier into a plurality of channels having a substantially equal internal volume.

The dispersant may be selected from any suitable dispersant, including the group consisting of superplasticizers, polynapthalene sulfonate, polymelamine sulphonate, carboxylated synthetic polymers, polyacrylates, aqueous sodium napthalene sulfonate formaldehyde polymer condensate (NSF), and mixtures thereof. In particular, the dispersants taught in the present inventor's U.S. Pat. No. 6,533,848, the disclosure of which is incorporated herein in its entirety by reference, are contemplated for use in the present invention. As necessary, the slurry may be brought to a suitable pH prior to adding the dispersant to further discourage the formation of flocs. Still further, the slurry may be brought to a concentration of solids of up to 20% prior to passing the slurry through the classifier. In one embodiment, the slurry may be brought to a concentration of solids of from about 5 to about 18%. Typically, the dispersant will be added to the slurry at a rate of between substantially 1.0 to 10.0 g/kg (dry solids basis) of the particle-containing material, although it will be understood that the specific amounts added will vary in accordance with the properties of the selected dispersant, and of the particle-containing material to be dispersed.

The slurry may be passed through the hydraulic classifier at a superficial velocity feed rate of up 40 cm/min. In one embodiment, the slurry is passed through the classifier at a superficial velocity of from about 5 to about 35 cm/min. However, it will be appreciated by the skilled artisan that the solids feed rate will be dictated by the size and capacity of the hydraulic classifier, by the nature of the particle-containing material selected, and by the desired grade of the product being recovered, rather than necessarily being a fixed parameter.

In another aspect, a method is provided for selective separation of particles from a particle-containing material, comprising preparing a slurry comprising the particle-containing material, a slurrying liquid, and a dispersant, providing a hydraulic classifier comprising a divider assembly defining at least one inclined channel, passing the slurry transversely across the divider assembly in a first direction, establishing a flow of particles in a second direction which defines a cross-current flow relative to the first direction, and recovering a first product comprising particles having a mean particle size of about 2-7 μm. As noted above, the particle-containing material may be a fly ash, but separation and beneficiation of other particle-containing substances are contemplated.

The divider assembly may comprise at least one divider disposed at a pitch that is greater than an angle of repose of the particle-containing material particles. The at least one divider may be disposed at an included angle of about 45° relative to a plane defined by a longitudinal axis of the classifier. In one embodiment, the divider assembly may comprise a plurality of substantially parallel dividers separating the classifier into a plurality of channels having a substantially equal internal volume. It will be appreciated that the flow of particles described above is established by orienting the dividers in the classifier whereby the surface of the dividers on which the particles settle is substantially transverse to the direction of slurry flow through the classifier. The method may further include the step of altering a yield and a grade of the first product by altering the distance between adjoining dividers.

At least one underflow adapted for removing particles may be provided at a bottom of the classifier. Used herein, "underflow" means an outlet, generally positioned at a bottom of a hydraulic classifier, for removal of coarse particles settling out of a particle-containing material such as fly ash. As is known in this art, several such underflows may be provided at a bottom of the classifier, to allow selective removal of particles of sequentially decreasing mean particle size. The method includes providing at least one outlet near an end of the classifier for recovering particles having a mean particle size of about 2-7 μm. In one embodiment, the at least one outlet comprises a submerged launder. Dispersant selection and addition to the particle-containing material slurry, as well as solids feed rate, may be as described above. Still further, the method of the present invention comprises recovery of a second product comprising a substantially pure population of cenospheres.

In yet another aspect of this invention, a hydraulic classifier is provided for recovering particles having a mean particle size in the range of 2-7 μm from a particle-containing material, comprising a body adapted for transporting a particle-containing slurry in a first direction, and at least one divider assembly disposed in an interior of the body. The divider assembly defines at least one inclined channel for establishing a flow of particles in a second direction that is different from the first direction. The flow of particles typically defines a cross-current flow relative to the first direction. As noted above, the particle-containing material may be a fly ash.

The body may include a pair of end walls, a pair of side walls, and a bottom defining a passageway having a substantially rectangular cross-section. In one embodiment, the body side walls are substantially parallel to a plane defined by the divider assembly. The at least one divider assembly may comprise at least one divider disposed at a pitch that is greater than an angle of repose of the particle-containing material particles. In one embodiment, the divider assembly is disposed at an included angle of about 45° relative to a plane defined by a longitudinal axis of the classifier. Typically, the divider assembly will comprise a plurality of substantially parallel dividers separating the classifier into a plurality of channels each having a substantially equal internal volume. As described above, the dividers are typically oriented such that the surface on which the particles settle is substantially transverse to the direction of flow of the slurry through the classifier, whereby the desired cross-current particle flow is established.

At least one underflow adapted for removing particles may be provided at a bottom of the body, whereby particles of sequentially decreasing mean particle sizes may be removed from the slurry. The body also typically includes at least one inlet near a top of a first end wall and at least one outlet near a top of a second, opposed end wall. In one embodiment, the at least one outlet comprises a submerged launder for selective removal of particles having a mean particle size of about 2-7 μm, without cross-contamination with other potentially useful particles, such as cenospheres in the case of fly ash. As will be described in greater detail below, other particle populations such as cenospheres may be removed also, providing another potentially valuable product stream from the device of the present invention.

Other objects and applications of the present invention will become apparent to those skilled in this art from the following description wherein there is shown and described a preferred embodiment of this invention, simply by way of illustration of the modes currently best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification illustrates several aspects of the present invention and, together with the description, serves to explain the principles of the invention. In the drawing.

Figure 1:
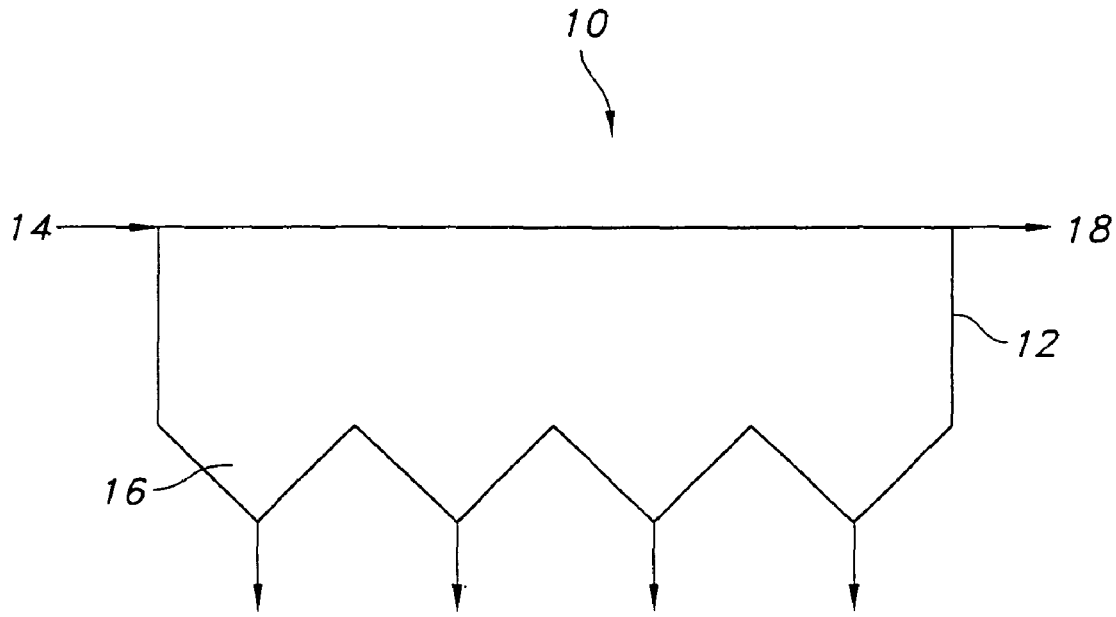
Fig. 1 Prior Art
FIG. 1 schematically illustrates a prior art open channel hydraulic classifier.

Reference will now be made in detail to the presently preferred embodiments of the invention, examples of which are illustrated in the accompanying drawings.

DETAILED DESCRIPTION OF THE INVENTION

In accordance with the identified need in the art, the present invention provides methods for hydraulic classification of particle-containing slurries, and devices for accomplishing the methods of the invention. The invention provides simple, economical methods and devices for hydraulic classification/beneficiation of slurries such as fly ash slurries, and advantageously allows separation of a fly ash product having an average mean particle size of from about 2-7 μm, without the need for subjecting the slurry to methods which, while having greater selectivity for such small particles than conventional hydraulic classification methods, suffer from the disadvantages of reduced efficiency in terms of throughput and recovery. It will be appreciated that the methods and devices of the present invention result, in the case of fly ash beneficiation, in an ultra-fine ash (UFA) end product having a significantly reduced loss on ignition (LOI), i.e., a significantly reduced carbon content. Such UFAs are valuable materials, for example for use as polymer fillers in the plastics industry, and as very highly active and effective pozzolanic additions to Portland cement-based mortars and concretes, and as interground material for Portland cement.

EXAMPLE 1

It was desired to develop a hydraulic classifier for reliably recovering fly ash particles having a mean particle size of 2-7 μm. It is well-known in the art that the sorting of very fine particles in hydraulic systems is dictated by Stokes Law, which states:

$$V_p = G(\rho_S - \rho)D^2/18\mu$$

where $V_p$ is the rising or settling velocity of the discrete particle, G is the gravity constant, $\rho_S$ is the density of the particle, ρ is the density of the carrier fluid, D is the diameter of the discrete particle, and 1 is the viscosity of the carrier fluid. Stokes Law assumes laminar flow and no interaction between particles, which is rarely the case in particle separations. It is known that the amount of movement caused by simple Brownian motion for a 1 micron particle is nearly equal to that of gravity. Indeed, Brownian motion effects are stronger than gravity for particles smaller than 1 micron. Another factor affecting particle separation in a fly ash slurry is the tendency of the fly ash to naturally flocculate. Still another factor hindering efficient separation is the tendency of larger particles to hinder movement and settling of smaller particles. Each of the foregoing factors cause conventional hydraulic classifiers to suffer from reduced efficiency in selecting for a particle size, such as a fly ash particle size, having a diameter of 7 μm or less. Accordingly, various methods and devices have been developed over the years in an attempt to address these factors for more efficient particle separations, such as fly ash particle separations.

It is known in the art to provide a horizontal open channel hydraulic classifier. A schematic example of such an open flow hydraulic classifier 10 is shown in FIG. 1. The hydraulic classifier includes a body 12, an inlet 14 allowing introduction of slurry, a plurality of underflows 16 allowing removal of coarse particles from a bottom of the classifier 10, and an outlet 18 allowing removal of particles which pass through the classifier 10 without settling. As noted previously, such conventional classifiers are unsuited for retrieval of particles 7 μm or less.

Figure 2:
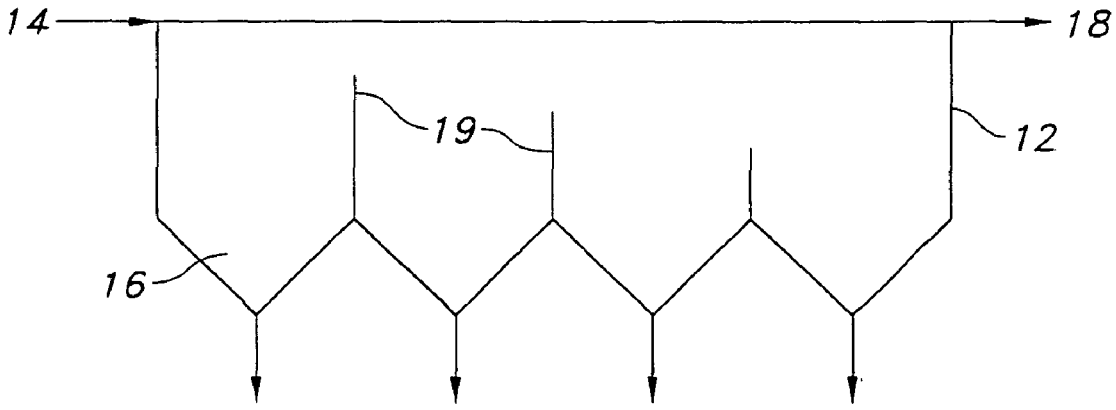
Fig. 2 Prior Art
FIG. 2 schematically depicts a prior art weir hydraulic classifier.

A similar known classifier design (shown schematically in FIG. 2), which is physically divided into cells using substantially vertical dividers 19 of differing heights, was also considered. Use of this classifier design was found to result in creation of a visible "mud line" which was thicker in the cells having the tallest dividers. This mud line defined a sediment compression zone, within which particle sorting was highly inefficient. It is believed that in tests utilizing the classifier depicted in FIG. 2, the tallest divider controlled the overall cross-sectional area of flow for the device and created a thick compression zone. It was necessary to overcome these disadvantages to create a hydraulic classifier suitable for selection of particles having a size of less than 7 μm.

Figure 3:
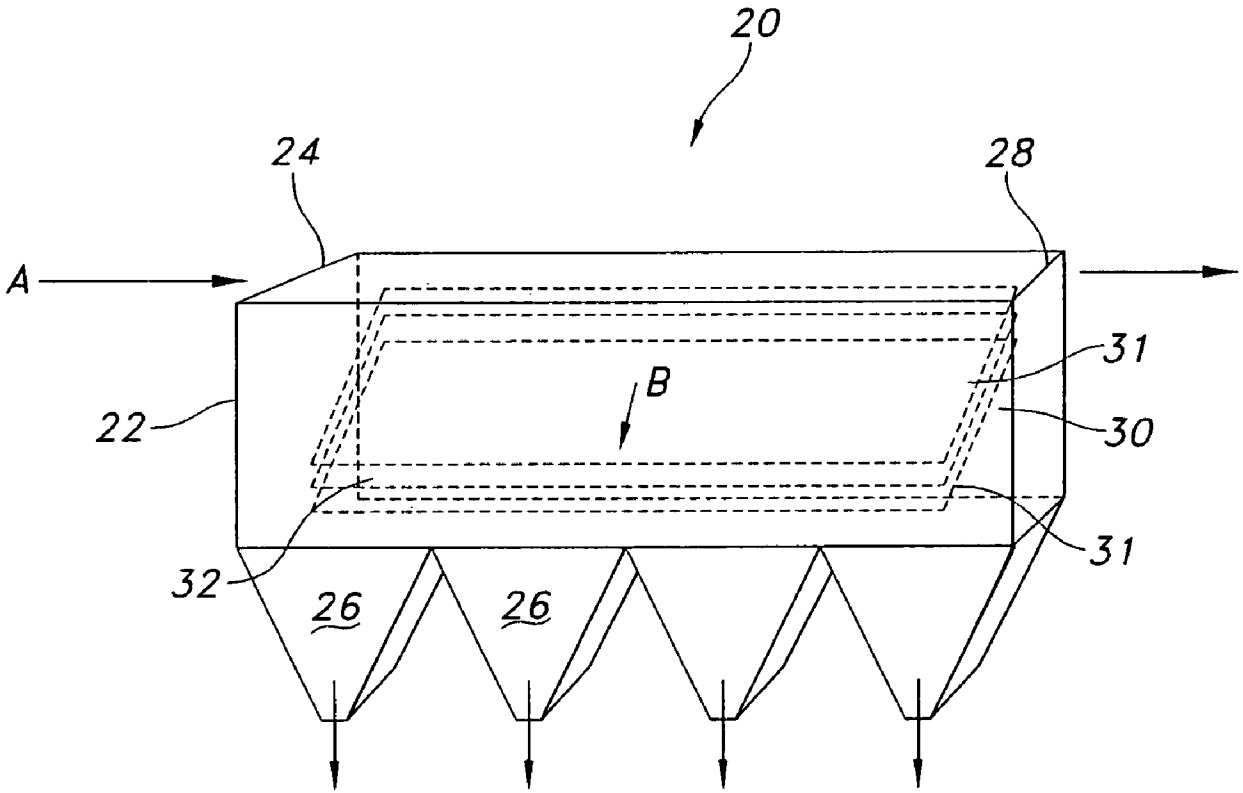
FIG. 3 schematically depicts one embodiment of the cross-flow hydraulic classifier of the present invention.

Accordingly, in one embodiment of the invention, shown schematically in FIG. 3, a hydraulic classifier 20 was provided having a body 22, an inlet 24 allowing introduction of slurry (not shown), a plurality of underflows 26 allowing removal of coarse particles from a bottom of the classifier 20, and an outlet 28 allowing removal of particles which pass through the classifier 20 without settling. Any suitable structure may be used for inlet 24, such as a manifold for dispersing slurry evenly across a top of the classifier body 22. It can be seen that the area above each underflow 26 can be considered an individual cell, although not physically divided as in the classifier depicted in FIG. 2.

A slurry flow may be established in a first direction represented by arrow A, from inlet 24 to outlet 28. The hydraulic classifier 20 further includes a divider assembly 30 comprising a plurality of dividers 31, defining a plurality of inclined channels 32. The inclined channels 32 allow a flow of fly ash particles in a downward direction (represented by arrow B) that is different from the direction of slurry flow. It will be appreciated that the dividers 31 are oriented such that the surface on which the particles settle is transverse to the direction of slurry flow (arrow A). In the depicted embodiment, particle flow (arrow B) substantially defines a cross-current flow relative to the direction of flow of the slurry (arrow A). In the illustrated example, an included angle of about 90 degrees is provided between the two directions of flow (arrows A and B). However, it should be appreciated that the included angle between the two directions of flow may vary significantly in accordance with the angle at which the dividers 31 are held, with the feed slurry flow rate, and the like.

Divider assembly 30 effectively creates a very wide, very shallow channel for slurry flow by folding the channel within the body 22, without altering the length or depth of body 22. It will be appreciated that it is desirable to orient dividers 31 at a pitch which exceeds an angle of repose of the fly ash particles, i.e., at a pitch which reduces the tendency of the particles to rest on the dividers 31 without moving, to prevent excessive sedimentation on the divider surfaces. In the depicted embodiment, dividers 31 are disposed at an included angle of about 45° from a plane defined by the longitudinal axis of the classifier body 22. However, the dividers 31 may be disposed at an included angle of from about 36° to about 70° without impairing efficiency of the classifier 20.

EXAMPLE 2

Figure 4:
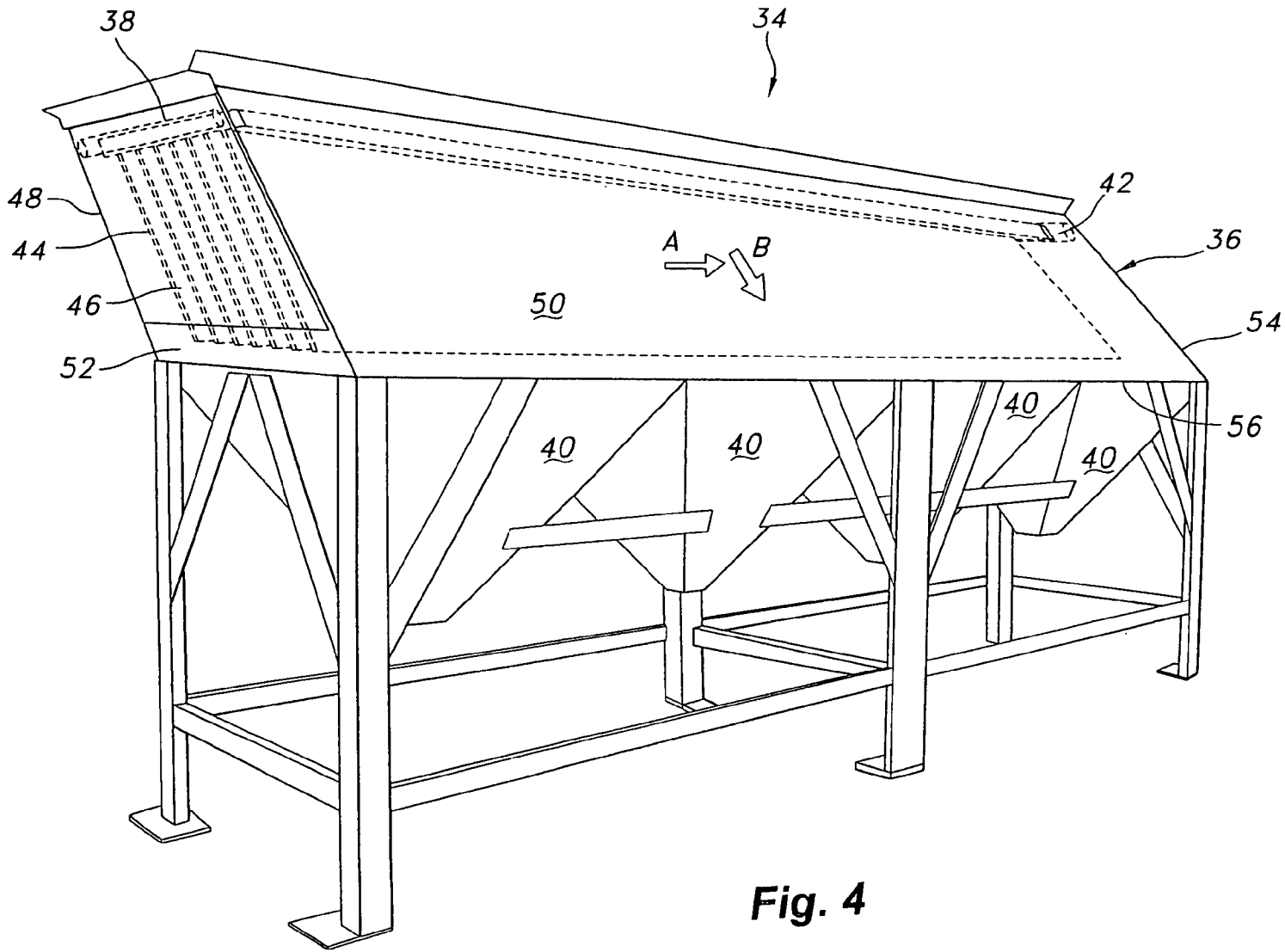
FIG. 4 shows a second embodiment of the cross-flow hydraulic classifier of the present invention.

Referring to FIG. 4, a hydraulic classifier 34 was fabricated substantially as described in Example 3, having a body 36, an inlet 38 such as a manifold, allowing introduction of slurry (not shown), four underflows 40 allowing removal of coarse particles from a bottom of the classifier 34, and a plurality of outlets 42 allowing removal of particles which pass through the classifier 34 without settling. In the depicted embodiment (see FIG. 4*a*), the outlets 42 are submerged launders 43 passing through an end wall of the body 36, comprising in the depicted embodiment a substantially tubular passageway 45 having an inlet 47 through which the desired particles pass to an outlet 49 from where the particles may be recovered for storage and/or further processing. The submerged launder creates a still zone which is useful for collection of ash and debris with densities less than 1 gm/cm.

The hydraulic classifier 34 further includes a plurality of dividers 44 defining a plurality of inclined channels 46. The body 36 is defined by a pair of end walls 48, 50, a pair of side walls 52, 54, and a bottom 56. As shown in FIG. 4, side walls 48, 50 are substantially parallel to the plane defined by the dividers 44 and channels 46. As described in Example 1, the dividers 44 are oriented whereby the surface on which particles settle is substantially transverse to the direction of slurry flow (represented by arrow A). Further, the dividers 44 are oriented at an angle which exceeds an angle of repose of the fly ash particles (about 45° from a plane defined by the longitudinal axis of the classifier body 36 in the depicted embodiment) to prevent excessive sedimentation on the divider 44 surfaces.

EXAMPLE 3

A total of 17 evaluations of the ability of various classifier designs to separate ash samples into a product having an average particle size of 2-7 μm were made, representing 31 separate determinations. Seven tests were made using the hydraulic classifier design (open flow) depicted schematically in FIG. 1. Four tests were run with the hydraulic classifier depicted in FIG. 3, and seven tests were run using a laboratory-scale hydraulic classifier having substantially the design as depicted in FIG. 4. Two of the tests utilized a polycarboxylate dispersant, and the remainder of the tests utilized naphthalene sulfonate formaldehyde condensate (NSF).

Feed rate, and indirectly therefrom the solids residence time in the hydraulic classifier, were considered in testing the various designs. The mean residence time (MRT) was calculated from average particle residence time as:

$$MRT=(Q_f+Q_1)/2V+(Q_1+Q_2)/2V+(Q_2+Q_3)/2V+(Q_3+Q_o)/2V$$

where: $Q_f$ was the primary flow into the classifier; $Q_1$ was the flow into the second cell (it is understood that the meaning of the term cell is as described above) of the classifier ($Q_1=Q_o-U_1$, where $U_1$ was the discharge to the underflow from the first cell, etc.); $Q_2$ and $Q_3$ were the flows into the third and fourth cells; $Q_o$ was the outflow of the product discharge; and V was the volume of each cell, in the tested embodiments approximately 51 liters. The volume of the cone shaped funnel at the bottom of the classifiers was considered to be still zone and part of the collection system, and omitted from the calculations.

Slurry feed rate through the classifiers was measured and adjusted until the product grade (defined as the meand particle diameter $D_{50}$ on a volumetric basis) was within a desired target range of 3-7 μm. Mass flow rate of product, underflow, and feed were measured, as well as percentage of solids and loss on ignition. Particle sizes of the feed, underflow, and product were measured using a laser diffraction particle size analyzer. Product yield (mass of product solids/mass of feed solids) and recovery (mass of product solids having a size of less than 7 μm divided by the feed mass of same) were calculated as percentages.

Figure 5:
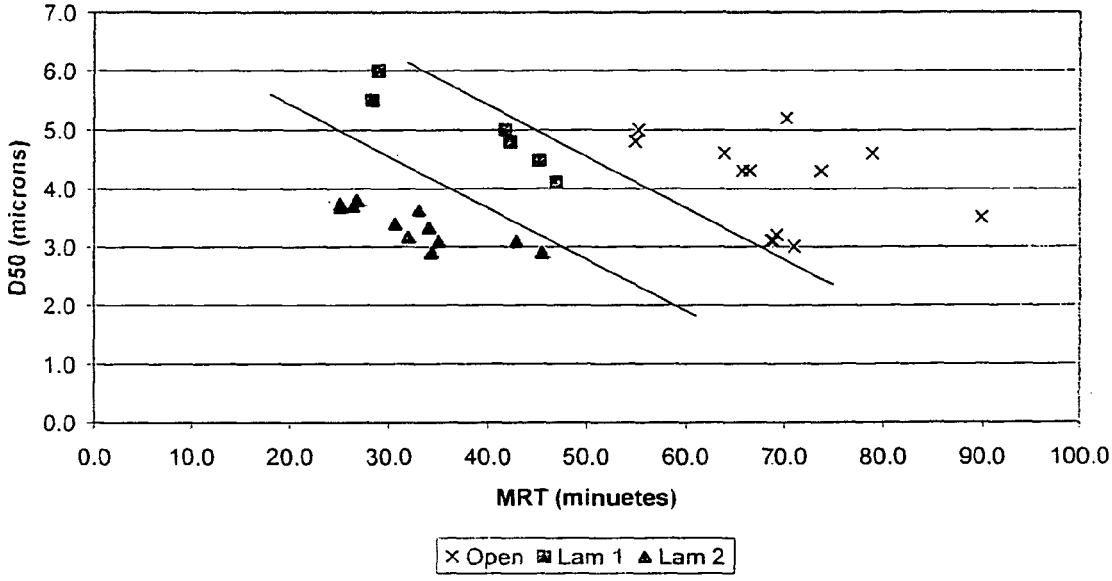
FIG. 5 graphically shows classification of a fly ash as mean residence time (MRT) versus $D_{50}$ of product size, comparing the classifiers of FIGS. 1, 3, and 4.

Performance of the three styles of hydraulic classifiers is shown in FIG. 5, plotted as MRT versus $D_{50}$. As shown therein, the conventional open flow classifier of FIG. 1 performed most poorly, with slow feed rates and resulting MRTs exceeding an hour required to produce a fly ash product having a $D_{50}$ in the 3-4 μm range. The hydraulic classifier of the present invention as depicted in FIG. 4 readily produced products having a $D_{50}$ in the desired 3-4 μm range with residence times as short as 24 minutes. The hydraulic classifier depicted in FIG. 3 exhibited an intermediate level of performance.

Performance was evaluated also by investigating product size as a function of feed rate. Average solids feed rate for the hydraulic classifier of FIG. 1 was 0.55 kg/min, producing a product having a $D_{50}$ of 4.1 μm. In comparison, the hydraulic classifier of FIG. 4 had an average solids feed rate of 1.0 kg/min and produced a product having a $D_{50}$ of 3.4 μm. Thus, the hydraulic classifier of FIG. 4 performed at a higher solids feed rate, and delivered a better grade of product than the conventional hydraulic classifier of FIG. 1.

Figure 6:
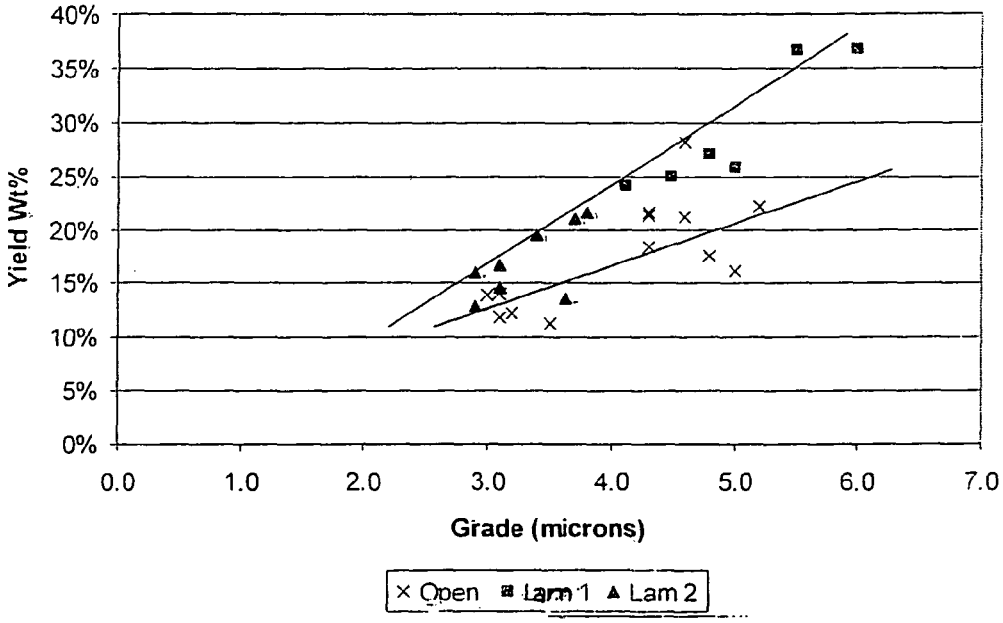
FIG. 6 graphically shows yield versus grade performance for the classifiers of FIGS. 1, 3, and 4.

Efficiency of the tested hydraulic classifier designs was considered by plotting grade versus yield (FIG. 6). The hydraulic classifiers of FIGS. 3 and 4 were clearly more efficient, as indicated by the steeper yield-grade curve.

EXAMPLE 4

Next, efforts focused on producing an ultra-fine ash (UFA) product using a hydraulic classifier 34 substantially as described in Example 2 and depicted in FIG. 4. Feed ash was conveyed into a slurry mix tank (not shown) and mixed with water to prepare a slurry with a pulp density of approximately ~15% solids (w/w). The prepared slurry was then pumped into a feed tank (not shown) over a screen to remove a small amount of >6 mesh material in order to prevent plugging, resulting in a feed hereinafter defined as a <6 mesh slurry. The −6 mesh slurry was then pumped into a primary hydraulic classifier (not shown) of a known design at the desired rate to effectively reject >100 mesh material (>150 μm), leaving a feed hereinafter described as a <100 mesh slurry. The <100 mesh slurry overflowed the primary classifier and was used as feed to the hydraulic classifier of the present invention. Preliminary testing was conducted by preparing a large volume of the <100 mesh slurry and retaining it in a 1500 gallon tank that was mixed with a re-circulating pump.

The desired dosage of dispersant (in this study, NSF) was mixed with the slurry and feed was metered into the hydraulic classifier 34 at the desired rate. The feed entered the hydraulic classifier 34 through a manifold. The hydraulic classifier included a substantially rectangular body 36 (16 ft long×4 ft wide×2 ft deep), having side walls 48, 50 inclined on a 45° angle. A series of parallel dividers 44 were installed along the length of the device, the parallel dividers being oriented substantially parallel to the side walls 48, 50, with a spacing of 7 cm between each divider 44.

Coarse particles accumulated on the dividers 44 and flowed to the bottom of the classifier 34 where they were collected in prism-shaped underflows 40, with the coarsest particles exiting the initial underflow 40, the next coarsest particle exiting the next underflow 40, and so on as described above. Accumulated coarse solids were removed from the underflows 40 with variable speed pumps.

The solids removed from the underflows 40 became finer at each succeeding underflow 40. In pilot tests (data not shown) with a classifier 34 having four underflows 40 (substantially as depicted in FIG. 4) the materials exiting the first underflow 40 had a mean diameter in the range of 30 to 50 μm. Materials exiting the second underflow 40 had mean particle diameters in the range of 20 to 30 μm. Materials exiting the third underflow 40 had mean particle diameters in the range of 15 to 25 μm, and materials exiting the fourth and final underflow 40 had a mean diameter in the range of 10 to 15 μm. Of course, the specific properties of the solids exiting the underflows 40 will vary in accordance with the properties of the starting material. However, it is important to note that each of the aforementioned materials were impoverished with regard to <10 μm (mean particle diameter) ash. The skilled artisan in this field will appreciate the value of such materials. For example, it is known to use such solids as components of ash-metal alloys and composites to impart additional desirable properties such as hardness to the alloys. Removal of fines from such solids is desirable, since the fines render the ash solids less wettable and therefore less useful as components of such alloys or composites. Accordingly, a method for removing ash fines from a potentially valuable population of larger diameter ash solids is provided.

Figure 4A:
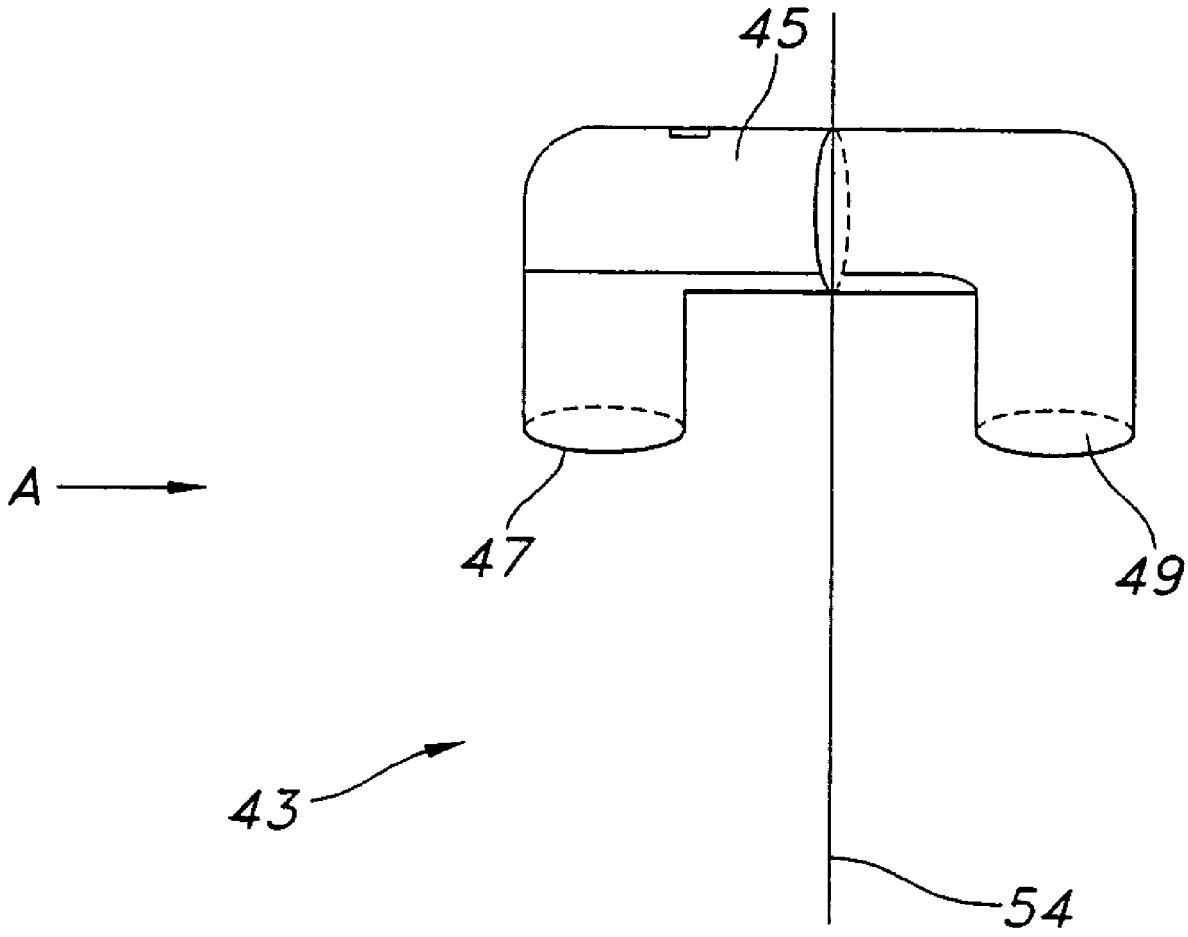
FIG. 4*a* shows the outlet 42 of FIG. 4 in isolation, in the depicted embodiment being a submerged launder 43.

The product slurry containing the UFA overflowed the device at the end opposite the feed point through outlets 42, being in the depicted embodiment submerged launders 43 as shown in FIG. 4*a*. The launders 43 were submerged to prevent cenospheres from exiting with the UFA product. During testing, the overflow slurry and all of the underflow slurries were combined and re-circulated back to the classifier feed tank. The system was allowed to operate for a length of time at least twice the retention time of the hydraulic classifier 34 before all product streams were sampled.

Figure 7:
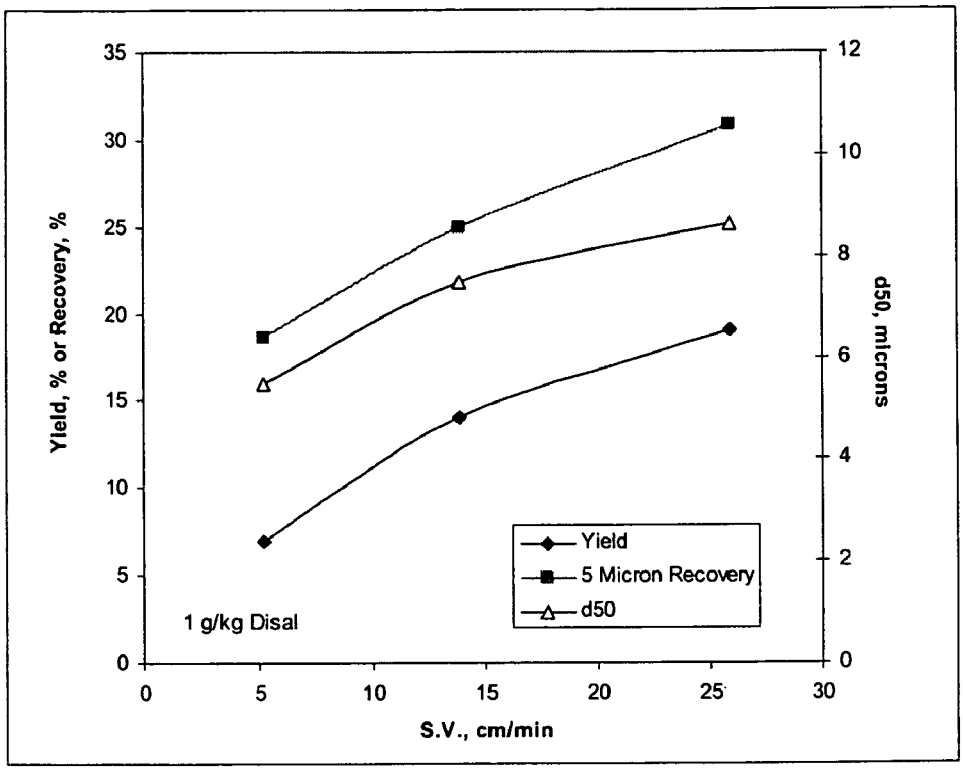
FIG. 7 graphically shows effect of superficial velocity of fly ash slurry feed on yield, recovery, and average particle size at a dispersant (40% NSF solution) concentration of 1 g/kg, using a classifier as depicted in FIG. 4.

Initially, it was desired to optimize the feed rate and dispersant dosage. Laboratory testing (see previous Examples) provided guidelines for both of these parameters. Data are presented as superficial velocity (SV), which is the average velocity of the slurry flowing through the device from the inlet end to the outlet end as adjusted for the underflow rate. Superficial velocity assumes plug flow and is calculated as the sum of $SV=(Q_1-Q_U)/A$ of the individual cells of the classifier, where $Q_1$ is the input flow to a cell, $Q_U$ is the underflow, and A is the cross-sectional area. As shown in FIG. 7, at minimal dosage, increasing SV increased the 5 μm recovery, yield and average particle size, $D_{50}$ of the product. At this dosage, increasing the SV from 5 to 25 cm/min increased the 5 μm recovery from 18 to 32% while the $D_{50}$ also increased, from 5.5 μm to 8.8 μm.

Figure 8:
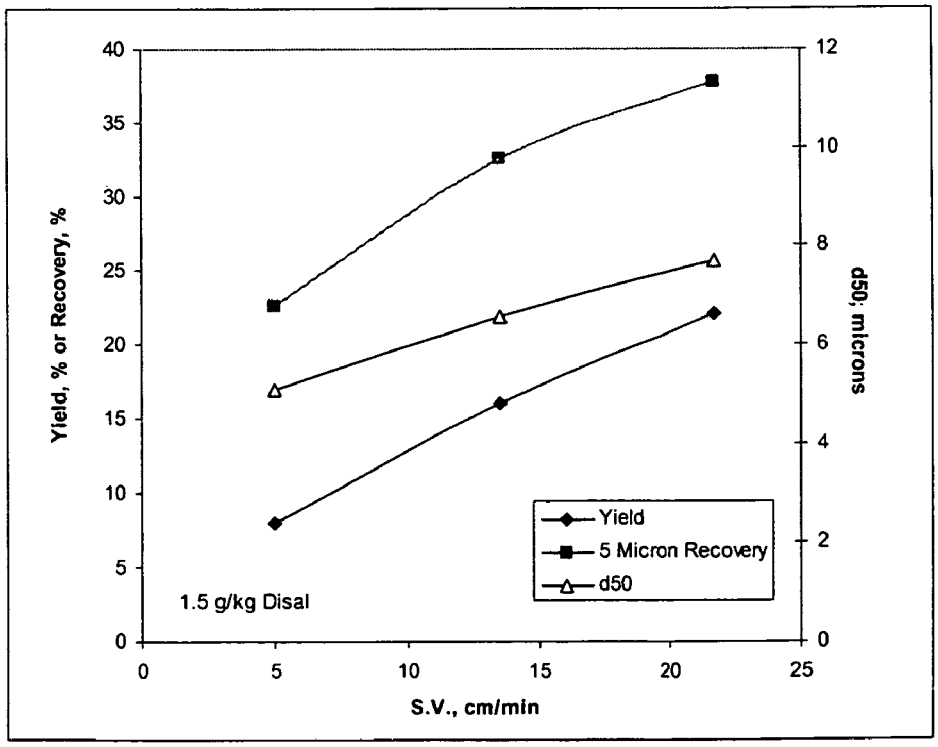
FIG. 8 graphically shows effect of superficial velocity of fly ash slurry feed on yield, recovery, and average particle size at a dispersant (40% NSF solution) concentration of 1.5 g/kg, using a classifier as depicted in FIG. 4.

Increasing the dispersant (in the present example, liquid NSF dispersant; DISAL) dosage to 1.5 g/kg provided similar trends with better results (FIG. 8). Over the same SV range (5 to 25 cm/min), the $D_{50}$ of the product was smaller (5.1 μm to 7.7 μm) than for the lower dosage. Recovery was also higher (22 to 38%).

Figure 9:
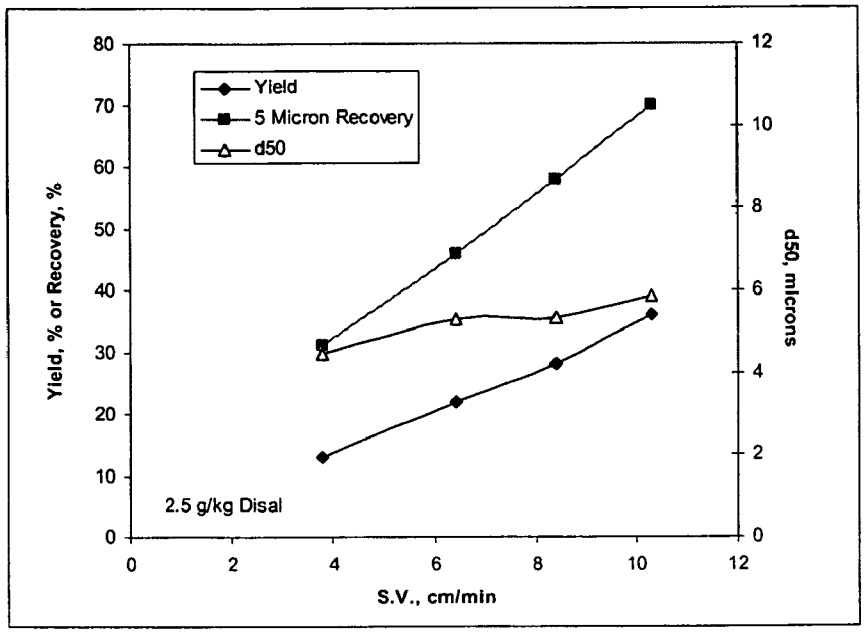
FIG. 9 graphically shows effect of superficial velocity of fly ash slurry feed on yield, recovery, and average particle size at a dispersant (40% NSF solution) concentration of 2.5 g/kg, using a classifier as depicted in FIG. 4.

Further increasing the dispersant dosage to 2.5 g/kg provided further improvement in terms of recovery, yield and lower average particle size (see FIG. 9). At a SV of 4 cm/min, a product with a $D_{50}$ of 4.6 μm was produced with a recovery of 31%. Increasing the SV to 10.5 cm/min increased the product $D_{50}$ to 5.9 μm, but the recovery of 5 μm particles increased to 70%.

The results shown in FIGS. 7, 8 and 9 clearly show that increasing dispersant dosage has a beneficial effect on the product size, recovery and yield. Also apparent from these results is that operating at lower SV is beneficial for product grade, but not for recovery and yield.

EXAMPLE 5

Figure 10:
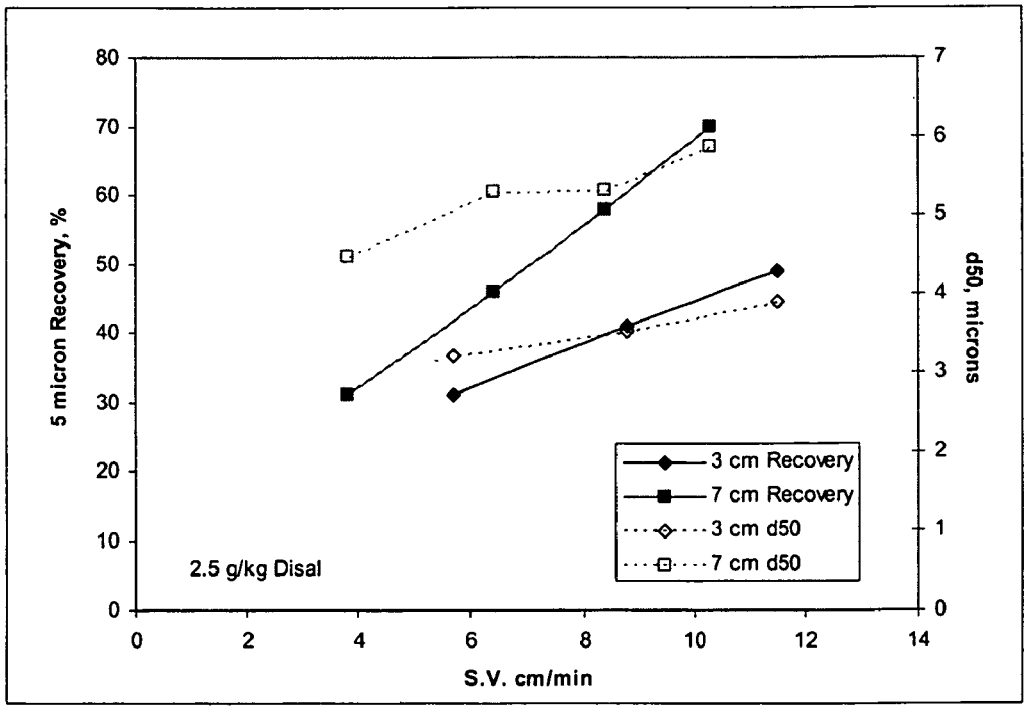
FIG. 10 graphically shows effect of divider spacing and superficial velocity of fly ash slurry feed on recovery, and average particle size at a dispersant (40% NSF solution) concentration of 2.5 g/kg, using a classifier as depicted in FIG. 4.

It was desired to evaluate the effect of spacing of the dividers 44 in the hydraulic classifier 34. Therefore, additional tests were conducted to determine if closer divider spacing would be beneficial; the results are shown in FIG. 10. When additional dividers were installed to provide a 3 cm spacing, recovery of 5 μm particles decreased, but the average particle size of the product improved. For example, with a dispersant (NSF) dosage of 2.5 g/kg and a S.V of 6 cm/min, 3 cm divider spacing provided a 5 μm recovery of 30% with a product grade ($D_{50}$) of 3.2 μm. Increasing divider spacing to 7 cm at the same SV increased the 5 μm recovery to 43%, but the $D_{50}$ of the product increased to 5.2 μm. The data (FIG. 10) clearly demonstrate that closer divider spacing produces a finer product size distribution.

EXAMPLE 6

Figure 11:
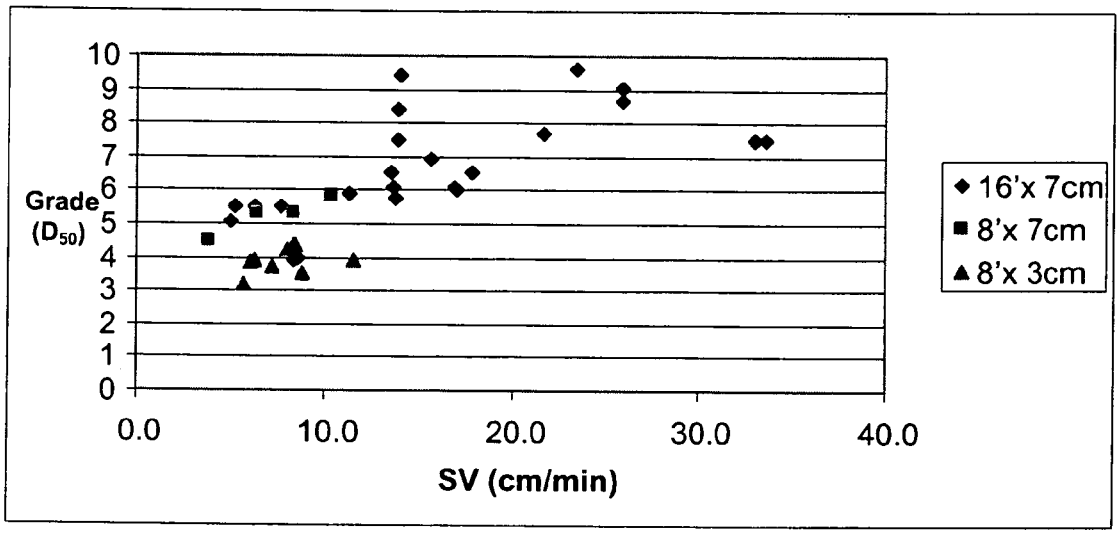
FIG. 11 graphically shows effect of divider length and number of overflows and superficial velocity of fly ash slurry feed on average particle size, using a classifier as depicted in FIG. 4.

Since lower superficial velocities seemed to provide the most desirable results, it was desired to evaluate the effect of decreasing the length of the dividers, in order to simplify the hydraulic classifier operation and to change the superficial velocity-retention time regime. For this reason, separation efficiencies of a classifier having 4 underflows and a classifier having 2 underflows were compared. The results presented in FIG. 11 show that reducing the length of the classifier from 16 ft to 8 ft, i.e., reducing the number of underflows from 4 to 2, did not adversely effect the average product size distribution. Tests were also made with the 8 ft classifier and closer divider 31 spacing (7 and 3 cm). The best (lowest $D_{50}$) product grades were made at SV's lower than approximately 15 cm/min and the closer divider spacings (FIG. 11).

EXAMPLE 7

Figure 12:
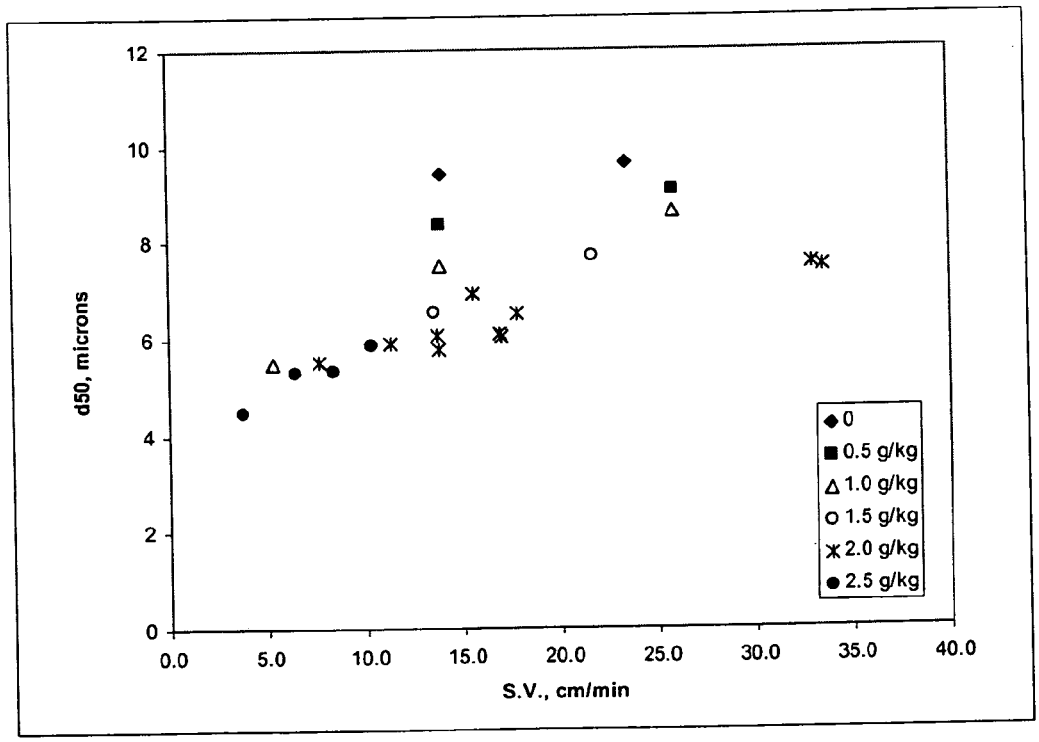
FIG. 12 graphically shows effect of dispersant (NSF) concentration and superficial velocity of fly ash slurry feed on product size, using a classifier as depicted in FIG. 4.

The principle function of the dispersant used in UFA production is to effectively disperse the finest ash particles in the slurry, preventing flocculation, to enable recovery of these particles in the classifier overflow. It is desirable to minimize the dispersant dosage from an economic perspective. The data shown in FIG. 12 shows that the minimum dosage of dispersant (40% NSF solution) was approximately 2 g/kg for the ash sample evaluated, as determined by the average particle size ($D_{50}$) of the product. Of course, it will be appreciated that the dosage of dispersant will vary significantly in accordance with the particular dispersant selected, and the physical and chemical nature of the ash classified. For example, certain ashes evaluated have required as little as 0.5 g/kg NSF (40% solution), while others have required up to 10 g/kg (data not shown). Corresponding polycarboxylate-based dispersant dosages have been found to be much lower, by a factor of ⅓ to ⅕ of the dosage of NSF required.

As the superficial velocity (SV) was increased from 4 to 35 cm/min, the $d_{50}$ of the product increased from 4.3 μm to 7.6 μm, for results generated with a DISAL dosage of 2 to 2.5 g/kg. At lower dosage (0.5 to 1.5 g/kg), the $D_{50}$ of the product was higher for a given SV. For example, at an SV of 14 cm/min. the $d_{50}$ of the product was 9.5 μm when no dispersant was used. As the dispersant (NSF) dosage was increased to 0.5, 1.0, 1.5 and 2.0 g/kg, the $D_{50}$ decreased from 8.6 to 7.5 to 6.3 to 5.8 μm, respectively.

EXAMPLE 8

To extend the preceding results, additional laboratory studies were conducted varying dispersant dosage and divider spacing. Superficial velocity and retention times were held constant during the tests at 4.1 cm/min±3.5% and 38.5 min±3.7% (1σ). Feed solids were held constant at (13.3%±7%) for all but one test. Dispersant dosages of 2.0, 2.5 and 3.0 mg/g liquid NSF dispersant (DISAL) to feed solids was tested. Divider spacing of 2.0 cm, 4.4 cm and 7.1 cm was used.

Figure 13:
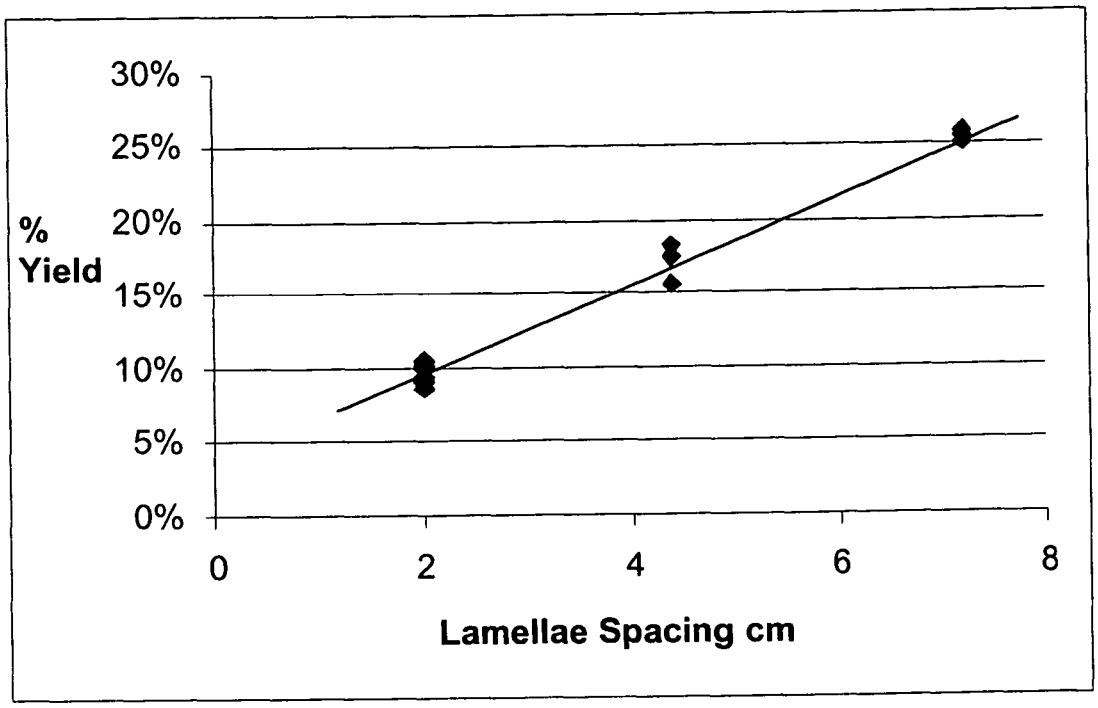
FIG. 13 graphically shows effect of divider spacing on yield and recovery from fly ash of particles having an average particle size of 5 μm, using a classifier as depicted in FIG. 4.

The divider spacing was found to strongly affect the products of classification. As expected, the product yield (product solids/feed solids) was found to be a positive function of divider spacing, with the closer spacing having lower yields. The yield increased by a factor of 250% over the spacing tested (FIG. 13). The recovery, defined as the product solids of <5 μm diameter/feed solids of <5 μm diameter, was found to be much more variable in nature, ranging from 50% to 70% at the wider spacing to 40% to 50% at 2 cm. In general the classifier was found to be highly efficient at recovering the fine particles.

Figure 14:
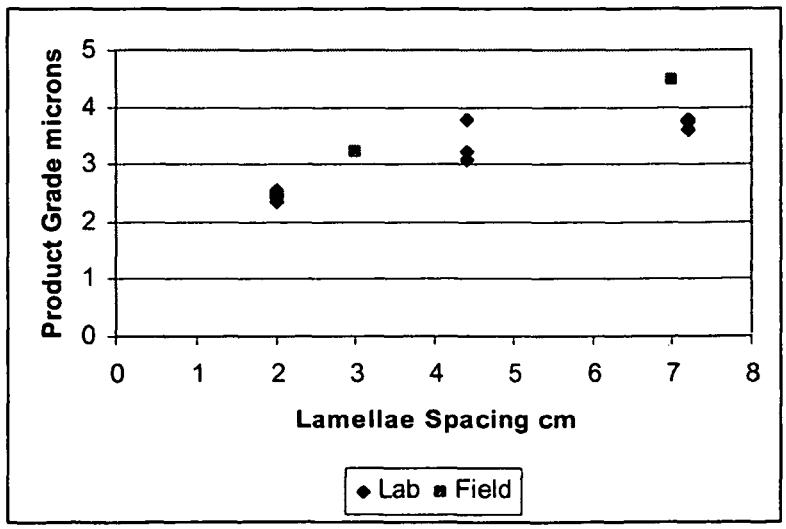
FIG. 14 plots fly ash product grade as a function of divider spacing, using a classifier as depicted in FIG. 4.

The grade of the product, as defined as the mean diameter of the product solids ($D_{50}$) was found to increase as a function of divider spacing, again as expected. Under the conditions of the tests the 2 cm spacing consistently produced products with a $D_{50}$ of 2.5 μm. The wider spacing produced coarser products. The product grade from the laboratory tests was congruent with those produced in the field tests described in Examples 4-7 (see FIG. 14).

EXAMPLE 9

Solids content in the feed was varied from ~14.6% to ~5% (Table 1), with divider spacing held constant at 2.0 cm. There was little difference found in yield, grade or recovery of the products from this test, indicating that the classifier operated a high efficiency across a very wide range of feed solids. During the tests series the average particle size of the feedstock varied from ~11 μm to ~24 μm, with no significant impact on the grade or recovery of the product measured.

TABLE 1

Comparison of Data for 2 cm lamellae spacing

| Feed % Solids | Dosage g/kg | Yield Wt % | Recovery Wt % 5 μm | Grade μm |
|---|---|---|---|---|
| 14.51 | 2.0 | 10.3% | 39% | 2.53 |
| 14.60 | 2.5 | 10.6% | 47% | 2.40 |
| 14.60 | 3.0 | 10.5% | 52% | 2.33 |
| 11.82 | 2.0 | 10.0% | 48% | 2.56 |
| 12.02 | 2.5 | 10.5% | 43% | 2.51 |
| 12.28 | 3.0 | 9.4% | 35% | 2.45 |
| 5.23 | 2.0 | 9.1% | 45% | 2.55 |
| 5.32 | 2.5 | 9.4% | 38% | 2.50 |
| 5.40 | 3.0 | 8.7% | 40% | 2.43 |

One of the variables that is difficult to determine accurately with the field apparatus is dispersant dosage requirements. The ash was re-circulated in the field trials, which allowed the equipment to be tested with a constant feed and without consuming a large amount of sample. However, the dispersant is in contact with the ash for long periods of time compared to what the practice would be, and some of it is "lost" i.e. adsorbed etc. Thus the effect of dispersant dosage was tested in the lab. To summarize the findings, higher dosages of dispersant did tend to produce materials with slightly improved grades (see Table 1), but did not significantly improve yield or recovery. The lab tests indicated that there was little benefit in using dispersants beyond a level of 2 g of dispersant/kg feed solids.

EXAMPLE 10

Cenospheres are a known by-product of coal combustion. These are hollow ash particles having bulk densities of less than 1 gm/cm$^2$ which are formed from coal combustion ash in the molten state. Because of the cenosphere's hardness, rigidity, light weight, water resistance, and insulative properties, they are highly useful in a variety of products.

The classifier of the present invention was clearly effective for separating and recovering cenospheres. The apparatus developed a thick floating layer of cenospheres during testing. Laboratory analyses allowed a concise measurement of the efficiency of removing cenospheres from the UFA product. Under the conditions of the tests (SV 4.1 cm/min, retention time 38 minutes), greater than 99% of the cenospheres in the feed sample were retained in the classifier still zone formed by the submerged launder for later recovery. This number is extrapolated conservatively, in that despite the thick floating layer of cenospheres observed in the apparatus during classification of the feed, cenospheres were undetectable in the final UFA product extracted using the submerged launder. Without wishing to be bound by any particular theory, it is hypothesized that the divider undersides provided a highly effective surface for separating and concentrating cenospheres, and that the submerged launder was effective in removing the desired UFA product without substantial cross-contamination by the floating cenospheres. Accordingly, yet another valuable by-product of the present method and device is provided.

It is accordingly shown that the present invention provides a hydraulic classifier that is effective for separation of particles, such as for producing an ultra-fine ash product from a mixed slurry of coal fines, along with at least one additional value-added by-product (cenospheres). Products with mean particle diameters of as small as 2.1 μm have been produced in both the laboratory and the field demonstration. The hydraulic classifier was shown to be highly efficient at recovering fine particles. For example, the recovery of particles less than 5 μm in diameter at levels of as high as 70% were recorded for sample grades in the range of 3 to 4 μm. Even for very fine sample grades (~2.5 μm), recoveries of particles less than 5 μm as high as 50% were measured.

Efficiency of the classifier was not significantly affected by feed solids content or feed fineness. However, divider spacing was found to be an important variable in modifying the process to recover a targeted end product. Dispersant was also shown to be beneficial to recovery of fine materials. Overall superficial velocity (SV) was shown to be an important variable in the hydraulic classifier. Reducing the SV provided better product grades (i.e. finer-sizes), but also reduced product yield. In consideration of product grade and recovery, using the hydraulic classifier dimension presented above, operating at a SV of less than 15 cm/min and retention times of from about 24 to about 35 minutes, provided acceptable results ($D_{50}$=3 to 6 μm, 30-70% 5 μm recovery) with reasonable dispersant dosages.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A method for selective separation of particles from a particle-containing material, comprising:

preparing a slurry comprising the particle-containing material, a slurrying liquid, and a dispersant;

providing a hydraulic classifier having a body and comprising a plurality of dividers defining a plurality of inclined, substantially parallel channels in an interior of the body, and a plurality of integral underflows adapted for selective removal and recovery of particles of sequentially decreasing mean particle size;

passing the slurry through a hydraulic classifier in a first direction at a superficial velocity of up to 40 cm/min;

establishing a flow of particles in a second direction that is different from the first direction;

recovering particles of sequentially decreasing mean particle size from the plurality of underflows; and recovering particles having a mean particle size of about 2-7 μm from an end of the hydraulic classifier body.

2. The method of claim 1, wherein the particle-containing material is a fly ash.

3. The method of claim 1, wherein the flow of particles defines a cross-current flow relative to the first direction.

4. The method of claim 1, wherein the divider assembly comprises a plurality of dividers disposed at a pitch that is greater than an angle of repose of the particle-containing material particles.

5. The method of claim 4, including disposing the plurality of dividers at an included angle of from about 36° to about 70° relative to a plane defined by a longitudinal axis of the classifier.

6. The method of claim 4, including providing a divider assembly comprising a plurality of substantially parallel dividers separating the classifier into a plurality of channels having a substantially equal internal volume.

7. The method of claim 1, including the step of bringing the slurry to a concentration of solids of up to about 25% prior to passing the slurry through the hydraulic classifier.

8. The method of claim 7, wherein the slurry is brought to a concentration of solids of from about 5 to about 18%.

9. The method of claim 1, including passing the slurry through the hydraulic classifier at a superficial velocity of from about 5 to about 35 cm/min.

10. A method for selective separation of particles from a particle-cotaining material, comprising:

preparing a slurry comprising the particle-containing material, a slurrying liquid, and a dispersant;

providing a hydraulic classifier having a body and comprising a divider assembly defining a plurality of inclined, substantially parallel dividers separating the classifier body into a plurality of inclined channels having a substantially equal internal volume;

wherein the hydraulic classifier includes a plurality of integral underflows adapted for selective removal and recovery of particles of sequentially decreasing mean particle size from a bottom of the hydraulic classifier body;

passing the slurry transversely across the divider assembly in a first direction at a superficial velocity of up to 40 cm/min;

establishing a flow of particles in a second direction which defines a cross-current flow relative to the first direction;

recovering a first product comprising particles having a mean particle size of about 2-7 μm from an end of the hydraulic classifier; and recovering at least one additional product comprising particles having a greater mean particle size than the mean particle size of the first product from at least one of the plurality of underflows.

11. The method of claim 10, wherein the particle-containing material is a fly ash.

12. The method of claim 10, including providing a divider assembly comprising a plurality of dividers disposed at a pitch that is greater than an angle of repose of the particle-containing material particles.

13. The method of claim 12, including disposing the plurality of dividers at an included angle of from about 36° to about 70° relative to a plane defined by a longitudinal axis of the classifier.

14. The method of claim 12, including the step of altering a yield and a grade of the first product by altering a distance between adjoining substantially parallel dividers.

15. The method of claim 10, further including providing at least one outlet for removing particles having a mean particle size of about 2-7 μm near an end of the classifier.

16. The method of claim 15, wherein the at least one outlet comprises a submerged launder.

17. The method of claim 10, further including the step of recovering a second product substantially comprising cenospheres.

18. The method of claim 10, including the step of bringing the slurry to a concentration of solids of up to about 25% prior to passing the slurry through the hydraulic classifier.

19. The method of claim 18, wherein the slurry is brought to a concentration of solids of from about 5 to about 18%.

20. The method of claim 10, including passing the slurry through the hydraulic classifier at a superficial velocity of from about 5 to about 35 cm/min.

21. A method for selective separation of particles from a particle-containing material, comprising:

preparing a slurry comprising the particle-containing material, a slurrying liquid, and a dispersant;

providing a hydraulic classifier having a body and comprising a plurality of dividers defining a plurality of inclined, substantially parallel channels in an interior of the body, and a plurality of integral underflows adapted for selective removal and recovery of particles of sequentially decreasing mean particle size;

passing the slurry through a hydraulic classifier in a first direction at a superficial velocity of from 7 cm/min to 15 cm/min;

establishing a flow of particles in a second direction that is different OM le first direction;

recovering particles of sequentially decreasing mean particle size from the plurality of underflows; and recovering particles having a mean particle size of about 2-7 μm from an end of the hydraulic classifier body.

* * * * *

UNITED STATES PATENT AND TRADEMARK OFFICE

CERTIFICATE OF CORRECTION

PATENT NO. : 7,963,398 B2
APPLICATION NO. : 11/451672
DATED : June 21, 2011
INVENTOR(S) : Thomas L. Robl et al.

It is certified that error appears in the above-identified patent and that said Letters Patent is hereby corrected as shown below:

Claim 10, column 14, line 45, please replace “particle-cotaining” with -- particle-containing --.

Claim 21, column 16, line 20, please replace “OM le” with -- from the --.

Signed and Sealed this
Fourth Day of October, 2011

David J. Kappos

David J. Kappos
*Director of the United States Patent and Trademark Office*